US006997392B2

(12) United States Patent
Klügl et al.

(10) Patent No.: US 6,997,392 B2
(45) Date of Patent: Feb. 14, 2006

(54) INJECTION VALVE COMPRISING A PUMP PISTON

(75) Inventors: Wendelin Klügl, Seubersdorf (DE); Günter Lewentz, Rogensburg (DE); Martin Neumaier, Regensburg (DE)

(73) Assignee: Siemens Aktiengesellschaft, Münich (DE)

( * ) Notice: Subject to any disclaimer, the term of this patent is extended or adjusted under 35 U.S.C. 154(b) by 0 days.

(21) Appl. No.: 10/399,076

(22) PCT Filed: Sep. 19, 2001

(86) PCT No.: PCT/DE01/03616

§ 371 (c)(1),
(2), (4) Date: Apr. 11, 2003

(87) PCT Pub. No.: WO02/31348

PCT Pub. Date: Apr. 18, 2002

(65) Prior Publication Data

US 2004/0041037 A1 Mar. 4, 2004

(30) Foreign Application Priority Data

Oct. 12, 2000 (DE) ..... 100 50 599

(51) Int. Cl.
*F02M 47/02* (2006.01)

(52) U.S. Cl. ..... 239/89; 239/92; 239/93; 239/95; 239/533.4; 239/102.2; 137/630.14

(58) Field of Classification Search ..... 239/89, 239/90, 91, 93, 95, 96, 124, 533.4, 533.8, 239/92, 102.2; 137/630.14, 625.65; 251/129.1
See application file for complete search history.

(56) References Cited

U.S. PATENT DOCUMENTS

| | | | | |
|---|---|---|---|---|
| 5,413,076 | A | 5/1995 | Koenigswieser et al. | |
| 5,463,996 | A * | 11/1995 | Maley et al. | 123/446 |
| 5,709,341 | A * | 1/1998 | Graves | 239/92 |
| 5,871,155 | A * | 2/1999 | Stockner et al. | 239/92 |
| 5,873,527 | A * | 2/1999 | Pattanaik et al. | 239/91 |
| 6,079,636 | A * | 6/2000 | Rembold et al. | 239/88 |
| 6,119,960 | A * | 9/2000 | Graves | 239/92 |

FOREIGN PATENT DOCUMENTS

| | | |
|---|---|---|
| DE | 19517578 | * 11/1995 |
| DE | 19701879 | * 7/1998 |
| DE | 19910970 | * 9/2000 |

* cited by examiner

*Primary Examiner*—Dinh Q. Nguyen
(74) *Attorney, Agent, or Firm*—Cohen, Pontani, Lieberman & Pavane

(57) ABSTRACT

The invention relates to an injection valve (1) comprising a booster piston (23), said piston delimiting a pump chamber (22) and a booster chamber (29). A valve (14) is provided in the inlet to the chamber (22). The valve is configured as a 3/2-way valve and controls the pressure in the pump chamber (22). The pressure in the pump chamber (22) is converted into a correspondingly increased pressure in the booster chamber (29) and in an injection chamber (34) containing an injection needle (6), by means of the booster piston (23). The use of the valve (14) allows a precise control of the injection times.

19 Claims, 3 Drawing Sheets

INJECTION VALVE COMPRISING A PUMP PISTON

PRIORITY CLAIM

This is a U.S. national stage of application No. PCT/DE01/03616, filed on 19 Sep. 2001. Priority is claimed on that application and on the following application(s): Country: Germany, Application No.: 100 50 599.6, Filed: 12 Oct. 2000.

BACKGROUND OF THE INVENTION

1. Field of the Invention

The invention relates to an injection valve with a pump piston.

2. Description of the Prior Art

Injection valves with a pump piston to raise the pressure of the injected fluid are used, for example, in automobile engineering to achieve particularly high injection pressures. In modern common-rail injection systems, for example, diesel fuel is injected into the combustion chamber of an internal-combustion engine at a pressure of up to 2000 bar.

A fuel injection system for internal combustion engines by which fuel is fed from a high-pressure accumulator to an injection valve is known from U.S. Pat. No. 5,413,076. The fuel is fed into a pump chamber which is delimited by one face of a pump piston. A second face of the pump piston delimits a booster chamber, which contains an injection needle. This injection needle is preloaded against the sealing seat, so that in its closed position the booster chamber is isolated from the spray holes. The injection needle is linked to a second piston, which delimits a control chamber. This control chamber is linked to a 3/2-way valve by a bore hole. The 3/2-way valve is in turn connected to a high-pressure accumulator by a second line, and via a third tube to a discharge line. The positional setting of the 3/2-way valve determines a predefinable pressure setting for the control chamber, and this controls the position of the injection needle. An additional controllable valve is provided between the high-pressure accumulator and the pump chamber, and this links the high-pressure chamber to the pump chamber as determined by the positional setting of the controllable valve. Control of the injection process is exercised by the positional settings of the 3/2-way valve and the additional valve.

SUMMARY OF THE INVENTION

It is the function of the invention to provide a simplified injection valve.

An advantage of the injection valve according to the present invention is that it is not necessary to have two controllable valves, but rather the injection is controlled by a single valve. In this case, the single valve is located in the feed line before the pump chamber. This provides a low-cost injection valve, which at the same time permits precise control of the injection process.

The valve according to the present invention may use a 3/2-way valve, by which a first line connection from an input line is linked to a second line connection to a first feeder line and a third line connection to a discharge line. The use of the 3/2-way valve allows precise control of the position of the injection needle.

In one embodiment of the inventive valve, a first valve chamber is provided with a first closing element, such that the input line opens into the first valve chamber and the first closing element holds an outflow opening open or closed depending on its positional setting.

The first closing element and an associated sealing seat may include a conical sealing surface, by which a simple and tight seal can be effected for the first valve chamber.

Preferably, the first closing element is connected to a second closing element by a rod. The second closing element is located in a second valve chamber and the rod passes through a connecting hole which links the first and second valve chambers to each other. In addition, a discharge line is connected to the second valve chamber. Depending on the positional setting of the valve, either the discharge line or the input line is connected to the feeder line.

The second valve element will preferably be linked so that it works in conjunction with an actuator which sets the positional setting of the first and second closing elements. The use of a single actuator for the first and second closing elements provides a simple form of embodiment of the valve.

The first and second valve chambers may be arranged along an axis, which is located either parallel to or along a central axis of symmetry of the injection valve. In this way a slim construction is achieved for the injection valve.

A piezoelectric actuator may be used to actuate the valve. To achieve a slim construction for the injection valve, it is of advantage if the piezoelectric actuator is located at the top end of the housing, with the piezoelectric actuator being partially inserted into the housing. In this way, a slim construction is achieved.

The piezoelectric actuator will preferably be arranged to be symmetrical with respect to the centre of the injection valve, as this will provide a particularly slim form for the design of the injection valve.

The third and fourth sealing surfaces of the second valve chamber and second closing element respectively may take the form of flat surfaces. This permits low-cost manufacture of the third and fourth sealing surfaces, while also enabling a good seal to be effected.

The operability of the pump piston is preferably improved by its first face having a recess which can be seated on a landing surface on the housing, such that the feeder line opens into the pump chamber in the vicinity of the landing surface. This will ensure that even when the pump piston is at its maximum displacement, the pump chamber retains a residual space, so that when the pump chamber is connected to the input line the pump chamber will rapidly fill with fluid, so that a rapid pressure rise is achieved in the injection chamber. The rapid rise in pressure makes it possible to exercise precise control over the start of the injection process.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
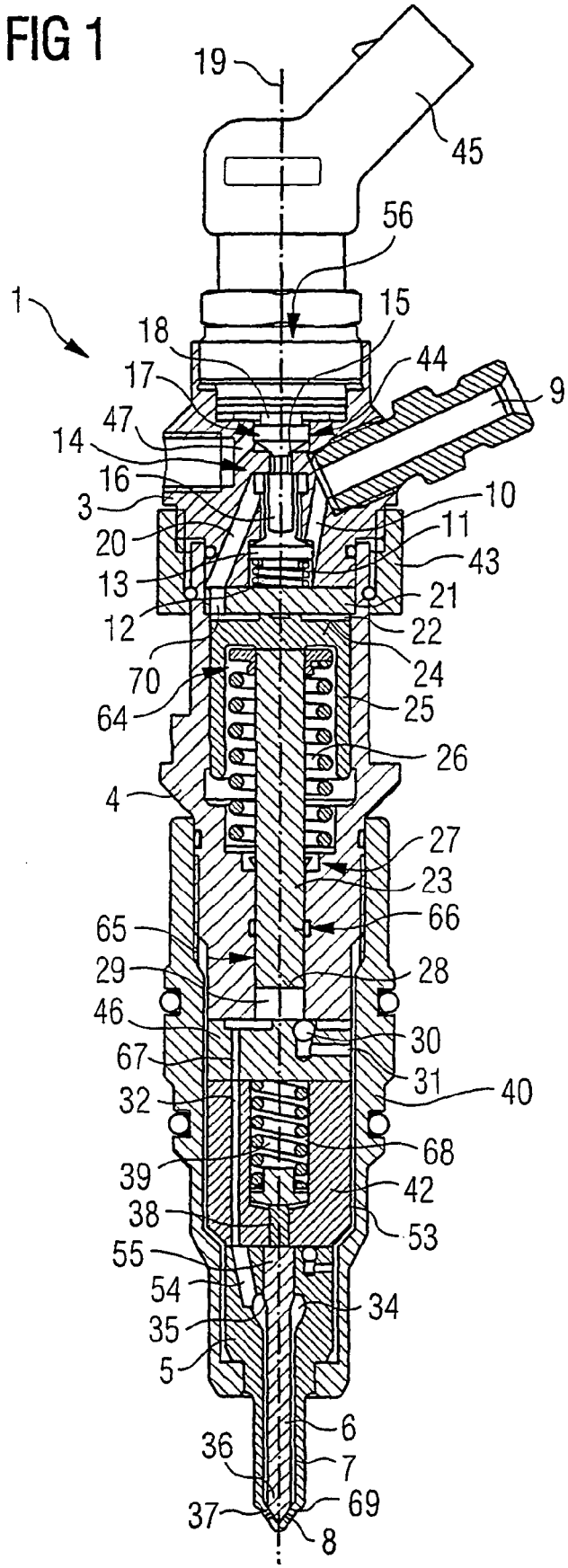
FIG. 1 is an schematic partial cross-sectional view of an injection valve according to the present invention.

FIG. 1 is a schematic partial cross-section diagram of an injection valve 1 with a central axis of symmetry 19, such as might be used for injecting diesel fuel into a diesel internal-combustion engine. The injection valve 1 has a valve body 3, which is attached to a pump body 4 by a sleeve 43. The pump body 4 is attached to a separator 46, a spring holder 42 and a nozzle body 5 by a sleeve 40.

The valve body 3 has an input connector 9, which is connected to an input line 10. The input line 10 feeds into a first valve chamber 11. This first valve chamber 11 is a part of the through borehole 56, which passes through the valve body 3 symmetrically with respect to the central axis. An actuator 18 is screwed into the top end of the through borehole 56 and seals off the top end of the through borehole 56. At the bottom end of the through borehole 56 is fitted a landing plate 21, which sits in a circular edge on the pump body 4, is pressed against the valve body 3 by the pump body 4, and which seals the bottom of the through borehole 56. The landing plate 21 thus delimits the first valve chamber 11. In the valve body 3 is fitted a valve 14, which is configured as a 3/2-way valve. As connections, the valve 14 has the input line 10, a first feeder line 20 and a discharge line 47. Depending on the setting of the valve 14, either the input line 10 or the discharge line 47 is connected to the first feeder line 20.

The first feeder line 20 feeds through a borehole 70 in the landing plate 21 to a pump chamber 22. Underneath the landing plate 21 and in the pump body 4 is located a moveable pump piston 64, the first face of which 24 delimits the pump chamber 22, which is formed within the pump body 4 between the landing plate 21 and the first face 24.

At the top of the pump piston 64 there is a cup-shaped shell 25, which is inserted into the pump body 4 to seal it off, and on which is the first face 24. Located within the shell 25 is a booster piston 23, which is preloaded towards the first face 24 by a second spring element 26. This second spring element 26 presses against a step in the pump body 4. At the top end of the booster piston 23, a landing ring is formed, against which the second spring element 26 presses. The bottom end of the booster piston 23 projects into a guide borehole 65 in the pump body 4 and seals the guide borehole 65. The booster piston 23 has a second face 28, which has a smaller cross-section than the first face 24 and which delimits a booster chamber 29, which is formed within the pump body 4. Preferably, between the pump body 4 and the booster piston 23 are located sealing elements 66, to seal the booster chamber. As an example, a sealing ring could be used as the sealing element.

The pump body 4 sits on the separating plate 46. The booster chamber 29 is thus delimited by the separating plate 46, the pump body 4 and the booster piston 23. A first borehole 67 through the separating plate 46 connects the booster chamber 29 with a third feeder line 32, which passes through the spring holder 42. The spring holder 42 abuts against the separating plate 46. In addition, there is a second feeder line 31 through the separating plate 46 which forms a connection, via an input valve 30, between the booster chamber 29 and a fuel chamber 53. The fuel chamber 53 is supplied via channels which are not shown with fuel at a low pressure. The input valve 30 ensures that the booster chamber 29 is always completely filled with fuel.

The third feeder line 32 leads to the nozzle body 5, and opens into a fourth feeder line 54 in the nozzle body 5, which leads to an injection chamber 34. The nozzle body 5 contains an injection needle 6 which can move axially, which in the region of the injection chamber 34 has a pressure surface 35. The injection needle 6 has a needle point 36, located in the region of the point of the nozzle body 5. There are spray holes 8 through the point of the nozzle body 5. The needle point 36 has a needle seat 37 which is located above the spray holes 8 and which has an associated sealing seat 69 built up on the nozzle body. If the injection needle 6 is positioned with the needle seat 37 on the sealing seat 69, there is then no connection between the injection chamber 34 and the spray holes 8. However, if the injection needle 6 with the needle seat 37 is lifted off the sealing seat 69, there is then a hydraulic connection between the injection chamber 34 and the spray holes 8, so that fuel from the injection chamber 34 is dispensed through the spray holes 8.

At the upper end of the injection needle 6 there is a guide section 55, which passes through a guide borehole in the nozzle body 5 and seals it hydraulically. The guide section 55 is attached to a connecting rod 38, which projects into the spring holder 42. The connecting rod 38 is attached to a third spring element 39, which is located in a spring chamber 68 in the spring holder 42. This third spring element 39 presses against the separating plate 46 and loads the injection needle 6 towards the sealing seat 69, which is located above the spray holes 8. If the fuel in the injection chamber 34 has a low pressure, then the injection needle 6 is pressed against the sealing seat 69 by the third spring element 39, so that there is no connection between the pump chamber 34 and the spray holes 8.

However, if the pressure in the injection chamber 34 is increased by a compression movement of the booster piston 23, then the pressure acts on the pressure surface 35 and, when the pressure required to raise it against the loading of the third spring element 39 is reached, will lift the injection needle 6 from the sealing seat, so that there is a hydraulic connection between the injection chamber and the spray holes 8. With the injection needle 6 in this position, fuel from the injection chamber 34 is dispensed through the spray holes 8.

Fuel which escapes from the injection needle 6 through a gap in the seal around the guide section 55 is bled off via a leakage valve 41 to the fuel chamber 53.

The positional setting of the valve 14 controls the pressure in the pump chamber 22, and thereby the compression stroke of the booster piston 23. The area of the first face 24 is greater than the area of the second face 28, so that a pressure increase is achieved between the pressure in the pump chamber 22 and the pressure in the booster chamber 29 and in the injection chamber 34.

The way in which the valve 14 functions is explained in more detail by reference to FIG. 2.

Figure 2:
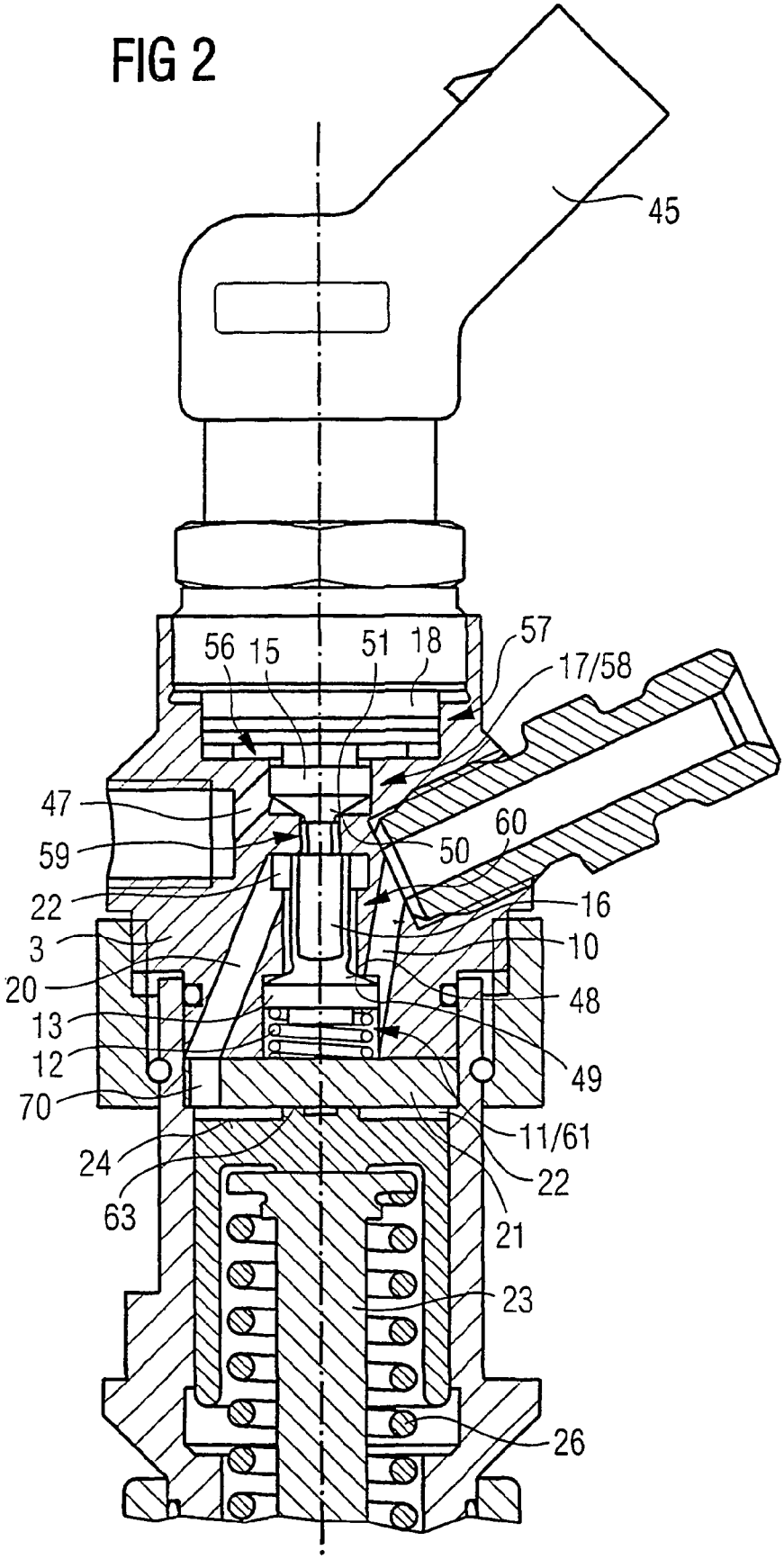
FIG. 2 is an enlarged partial cross-sectional view of part of the injection valve of FIG. 1.

FIG. 2 shows an enlarged diagram of the valve body 3. The valve body 3 has a central through borehole 56, which is sealed off at its upper end by the actuator 18 and at its lower end by the landing plate 21. The through borehole 56 has a first section 57 into which is screwed the actuator 18 with its housing. There is a step between the first section 57 and a second section 58, which represents a second valve chamber 17. This second section 58 has a smaller cross-section than the first section 57. The second section 58 is adjoined in turn by a third section 59, with this third section 59 having a smaller cross-section than the second section 58. The third section 59 is adjoined by yet a fourth section 60, which has a larger cross-section than the third section 59. The fourth section 60 is divided by a step from an adjoining fifth section 61, which has a larger cross-section than the fourth section 60. The fifth section 61 represents the first valve chamber 11.

The actuator 18 is preferably constructed as a piezoelectric actuator, with electrical connections 45. Control wires are connected to the electrical connections 45, these being linked to a control device. This control device controls the actuator 18 in accordance with prescribed procedures and depending on the operating parameters of the internal combustion engine.

The actuator 18 is linked so that it works in conjunction with a second closing element 15, this second closing element 15 being located in the second valve chamber 17. The second closing element 15 has a fourth sealing surface 51, which is associated with a third sealing surface 50. The third sealing surface 50 is built up on the valve body 3 in the transitional area between the second and third sections 58, 59. Furthermore, the second closing element 15 has a rod 16, which passes through the third section 59 and the fourth section 60 to the first valve chamber. The rod 16 is attached to a first closing element 13, which is essentially located in the first valve chamber 11. The first closing element 13 has a second sealing surface 49, which is associated with a first sealing surface 48. The first sealing surface 48 is located on the valve body 3 in the transition area between the fourth and fifth sections 60, 61. Located in the first valve chamber 11 is a first spring element 12, which preloads the first closing element 13 in the direction of the first sealing surface 48.

The second sealing surface 49 on the first closing element 13, and the fourth sealing surface 51 on the second closing element 15, are constructed as conical surfaces. The third and first sealing surfaces, 50, 48 are correspondingly constructed as conical surfaces, to ensure that a secure seal is effected by the first and second closing elements 13, 15. The rod 16 spaces the first and the second closing elements 13, 15 and connects them together permanently in such a way that, depending on the positional displacement of the actuator 18, the first or the second closing element 13, 15 sits on its associated sealing seat 48, 50 and thus either the input line 10 or the discharge line 47 is connected to the first feeder line 20. To achieve this, the rod 16 is made with a smaller cross-section than that of the second and third sections 59, 60 of the through borehole 56.

Preferably, the fourth section 60 will have an enlarged annular channel 62, to which the first feeder line 20 is connected. This will ensure an improved hydraulic feed to the pump chamber 22.

The function of the present invention is now explained by reference to FIGS. 1 and 2. If no fuel is to be injected, the actuator 18 is not activated and the first closing element 13 remains on its associated sealing seat 48, so that there is no connection between the input connector 9 and the pump chamber 22. As a result, the pump piston 64 remains in the upper position due to its preloading by the second spring element 26, and no high pressure is generated in the injection chamber 34. In consequence, the injection needle 6 is pressed against its associated sealing seat 69 by the third spring element 39, and there is no connection between the injection chamber 34 and the spray holes 8. In addition, the pump chamber 22 is connected to the discharge line 47 via the first feeder line 20 and the fourth, third and second sections 60, 59, 58. The discharge line 47 is connected to a return line and is only at a low pressure. The pump chamber 22 is thus under only low pressure.

Preferably, the first face 24 will have a raised landing surface 63, which can be seated on the landing plate 21 when the pump chamber 22 is under no pressure. The landing surface 63 should preferably be ring shaped in construction and has the advantage that in the region of the borehole 70, through which the first feeder line 20 opens into the pump chamber 22, there is a defined gap between the first face 24 and the landing plate 21, so that there is always a residual space in the pump chamber 22. Due to this residual space, when the valve 14 is opened fluid will be forced into the pump chamber 22 and will apply the prescribed pressure to the total area of the first face 24, so that movement of the pump piston 64 will be rapidly effected.

If fuel is to be injected, the control device will activate the actuator 18 in such a way that the actuator 18 makes a downward excursion, and thereby presses the second closing element 15 with the fourth sealing surface 51 onto the associated third sealing surface 50, thus breaking the connection between the discharge line 47 and the first feeder line 20. Simultaneously, this movement of the second closing element 15 is transmitted by the rod 16 and pushes the first closing element 13 away from the first sealing surface 48, thus opening a connecting area between the first feeder line 20 and the input line 10. The input line 10 is connected via the input connector 9 to a fluid reservoir, preferably a reservoir of fuel at a prescribed pressure. Hence the fluid will flow into the pump chamber 22 at the prescribed pressure, and will press the pump piston 64 in a downward direction, against the preloading force due to the second spring element 26, towards the booster chamber 29. The booster chamber 29 is completely full of fuel, so that the pressure through the first borehole 67, the fourth feeder line 54, the third feeder line 32 and in the injection chamber 34 is increased. If the pressure in the injection chamber 34 rises above a prescribed lift-off pressure, then the pressure on the pressure surface 35 acts against the preloading force of the third spring element 39 to lift the injection needle 6 from the sealing seat, so that fuel is dispensed from the injection chamber 34 through the spray holes 8.

The fuel reservoir used should preferably a fuel store of the type referred to as a common-rail, by which the input connection 9 is supplied with fuel under a pressure of up to 500 bar.

When fuel injection is to be terminated, the actuator will be appropriately activated so that it withdraws in an upward direction. As a consequence, the spring element 12 will move the first and second closing elements 13, 15 into the closed position, with the first closing element 13 landing on the first sealing surface 48 and the second closing element 15 being lifted in an upward direction off the third sealing surface 50. As a result, the connection between the input line 10 and the first feeder line 20 is broken, and the first feeder line 20 is again connected to the discharge line 47. This allows the fluid present in the pump chamber 22 to escape via the discharge line 47. As a result, the booster piston 23 is moved in an upward direction by the second spring element 26. In consequence, the pressure drops in the injection chamber 34 and the injection needle 6 is pressed against the sealing seat 69 by the third spring element 39. When the injection needle 6 has landed on the sealing seat 69, the connection between the injection chamber 34 and the spray holes 8 is broken, so that fuel injection is terminated.

Figure 3:
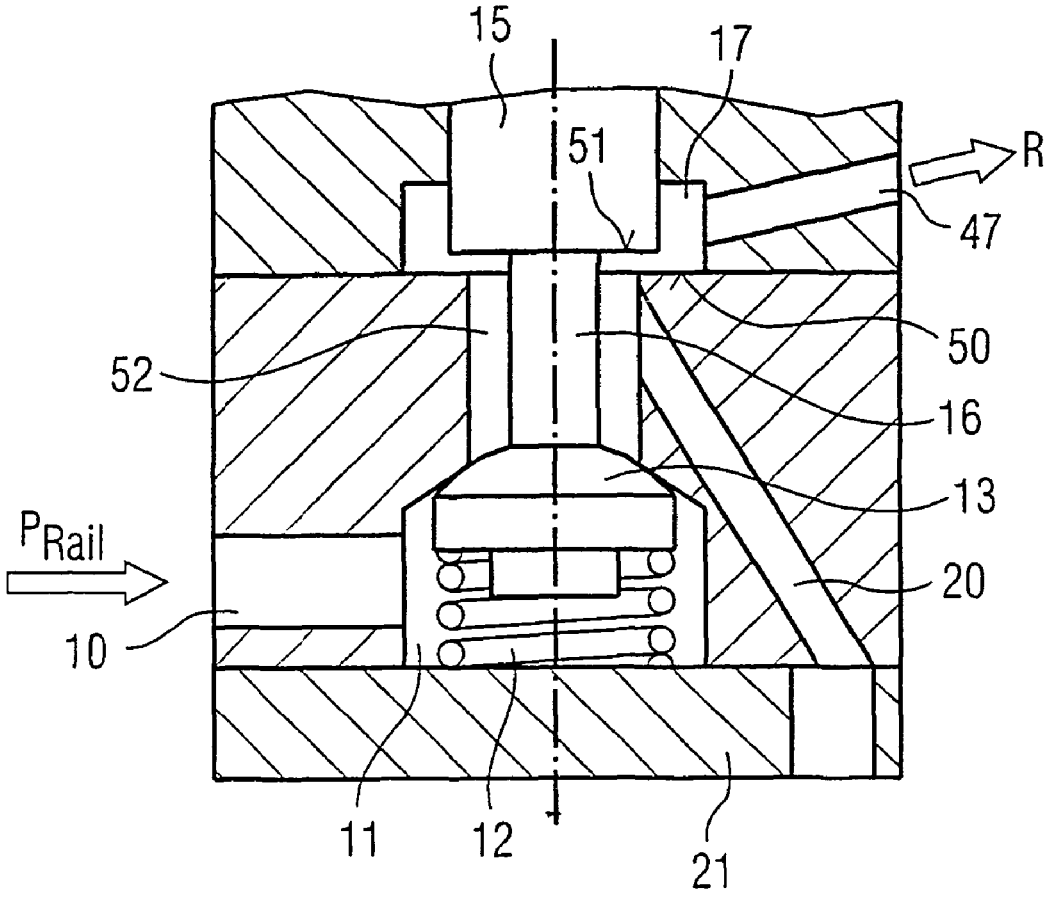
FIG. 3 is a cross-sectional of view of a valve to control the pressure in a booster chamber of the injection valve of FIG. 1.

FIG. 3 shows a further form of embodiment of the invention, in which the fourth sealing surface 51 on the second closing element 15 takes the form of a plane surface, which is associated with a correspondingly planar form for the third sealing surface 50. These forms of embodiment for the fourth and third sealing surfaces 51, 50 are simple and cheap to manufacture.

In a further advantageous form of embodiment, several first feeder lines 20 are provided, connecting the valve 14 with the pump chamber 24. This arrangement of several first feeder lines 20 permits faster filling and emptying of the pump chamber 24.

What is claimed is:

1. An injection valve, comprising:

a housing defining an input line;

a controllable first valve arranged in said housing and connected to the input line defined in said housing;

a pump piston having a first face and a second face arranged in said housing, wherein said housing and said second face of said pump piston delimit a pump chamber, the input line feeding the pump chamber through said first valve, said housing and said first face of said pump piston defining a booster chamber, wherein said first valve comprises a 3/2-way valve having a first line connection connected to the input line, a second line connection connected to a first feeder line defined in said housing and connected to the pump chamber, and a third line connection connected to a discharge line defined in said housing, the first feeder line being connected to the input line in a first operating state of said first valve and the first feeder line being connected to the discharge line in a second operating state of said first valve;

a second valve selectively connecting said booster chamber and a fuel reservoir defined by said housing, said housing further defining an injection chamber connected to said booster chamber, wherein said pump piston transmits a pressure in the pump chamber to produce a higher pressure in the booster chamber and the injection chamber; and a movable injection needle projecting into the injection chamber, said injection needle having a pressure surface in the injection chamber, said injection needle being movable for selectively opening or closing spray holes defined in said housing, wherein a position of said injection needle is set in response to the pressure in the pump chamber which is controlled by said first valve.

2. The injection valve of claim 1, wherein said first valve includes a first valve chamber connected to the input line, a sealing seat formed in the first valve chamber around an outflow opening connected to the first feeder line, said first valve further comprising a first closing element movable into sealing engagement with said sealing seat, said first closing element being moveable to selectively connect the first valve chamber to the first feeder line.

3. The injection valve of claim 2, wherein said first closing element has a first conical sealing surface and said sealing seat has a second conical sealing surface.

4. The injection valve of claim 3, wherein said first valve further includes a second valve chamber connected to the discharge line and a connecting borehole connecting said first valve chamber and said second valve chamber, said first valve further comprising a second closing element in the second valve chamber and a rod connecting said first closing element to said second closing element, said rod passing through said connecting borehole.

5. The injection valve of claim 4, further comprising an actuator linked with said second closing element, wherein said first and second closing elements are positioned in response to said actuator.

6. The injection valve of claim 5, wherein said injection valve comprises a central axis of symmetry and said first and second valve chambers are arranged along a line parallel to said central axis of symmetry.

7. The injection valve of claim 6, wherein said first and second valve chambers are arranged along said central axis of symmetry.

8. The injection valve of claim 4, wherein the second valve chamber has a sealing seat with a third sealing surface surrounding an inlet opening connected to the connecting borehole, and said second closing element includes a fourth sealing surface associated with said third sealing surface.

9. The injection valve of claim 8, wherein said third and fourth sealing surfaces are conical surfaces.

10. The injection valve of claim 8, wherein said third and fourth sealing surfaces comprise planar surfaces and said connecting borehole is connected to the first feeder line.

11. The injection valve of claim 8, wherein said third and fourth sealing surfaces are sealingly engaged in said first operating state and said first and second sealing surfaces are sealingly engaged in said second operating state.

12. The injection valve of claim 4, further comprising a landing plate arranged between said first valve and said pump piston, wherein said first face of said pump piston comprises a raised landing surface, said pump piston being movable to a position in which said raised landing surface abuts said landing plate, said feeder line opening into said pump chamber in an area outside the landing surface.

13. The injection valve of claim 1, further comprising a piezoelectric actuator connected for actuating said first valve.

14. The injection valve of claim 13, wherein said housing comprises an upper end proximate said first valve and a lower end proximate said spray holes, said actuator being at least partially inserted into said upper end of said housing.

15. The injection valve of claim 14, wherein said injection valve comprises a central axis of symmetry and said piezoelectric actuator comprises a central axis located on the central axis of symmetry of said injection valve.

16. The injection valve of claim 4, further comprising a piezoelectric actuator connected for actuating said first valve.

17. The injection valve of claim 16, wherein said housing comprises an upper end proximate said first valve and a lower end proximate said spray holes, said actuator being at least partially inserted into said upper end of said housing.

18. The injection valve of claim 17, wherein said injection valve comprises a central axis of symmetry and said piezoelectric actuator comprises a central axis located on the central axis of symmetry of said injection valve.

19. An injection valve, comprising:

a housing defining an input line;

a controllable first valve arranged in said housing and connected to the input line defined in said housing;

a pump piston having a first face and a second face arranged in said housing, wherein said housing and said second face of said pump piston delimit a pump chamber, the input line feeding the pump chamber through said first valve, said housing and said first face of said pump piston defining a booster chamber;

a second valve selectively connecting said booster chamber and a fuel reservoir defined by said housing, said housing further defining an injection chamber connected to said booster chamber, wherein said pump piston transmits a pressure in the pump chamber to produce a higher pressure in the booster chamber and the injection chamber;

a movable injection needle projecting into the injection chamber, said injection needle having a pressure surface in the injection chamber, said injection needle being movable for selectively opening or closing spray holes defined in said housing, wherein a position of said injection needle is set in response to the pressure in the pump chamber which is controlled by said first valve; and a landing plate arranged between said first valve and said pump piston, wherein said first face of said pump piston comprises a raised landing surface, said pump piston being movable to a position in which said raised landing surface abuts said landing plate, said first valve comprising a feeder line opening into said pump chamber in an area outside the landing surface.

* * * * *